US009476591B2

(12) United States Patent
Tuttle et al.

(10) Patent No.: US 9,476,591 B2
(45) Date of Patent: Oct. 25, 2016

(54) CRACK RESISTANT COMBUSTOR

(75) Inventors: Mark Edward Tuttle, Portland, CT (US); Robert M. Sonntag, Manchester, CT (US); John H. Nixon, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 2498 days.

(21) Appl. No.: 12/160,226

(22) PCT Filed: Mar. 14, 2006

(86) PCT No.: PCT/US2006/009218

§ 371 (c)(1),
(2), (4) Date: Jul. 8, 2008

(87) PCT Pub. No.: WO2007/106087

PCT Pub. Date: Sep. 20, 2007

(65) Prior Publication Data

US 2009/0235666 A1 Sep. 24, 2009

(51) Int. Cl.
*F23R 3/28* (2006.01)
*F23R 3/34* (2006.01)

(52) U.S. Cl.
CPC ..... *F23R 3/283* (2013.01); *F23R 3/343* (2013.01); *F23R 2900/00005* (2013.01); *Y10T 29/4932* (2015.01); *Y10T 29/49346* (2015.01)

(58) Field of Classification Search
CPC ..... F23R 3/283; F23R 3/343; F23R 2900/00005; Y10T 29/49346; Y10T 29/4932
USPC ..... 60/752, 754, 755, 757
See application file for complete search history.

(56) References Cited

U.S. PATENT DOCUMENTS

| | | | | |
|---|---|---|---|---|
| 3,016,703 | A | 1/1962 | Andre et al. | |
| 4,242,871 | A * | 1/1981 | Breton | 60/757 |
| 4,413,477 | A * | 11/1983 | Dean et al. | 60/757 |
| 4,614,082 | A | 9/1986 | Sterman et al. | |
| 6,101,814 | A | 8/2000 | Hoke et al. | |
| 6,792,757 | B2 * | 9/2004 | Borns et al. | 60/772 |
| 6,986,201 | B2 * | 1/2006 | Moertle et al. | 29/890.01 |
| 2003/0115886 | A1 | 6/2003 | Farmer et al. | |
| 2009/0077975 | A1 * | 3/2009 | Scholz et al. | 60/752 |

FOREIGN PATENT DOCUMENTS

| | | | |
|---|---|---|---|
| EP | 1160512 | A2 | 12/2001 |
| GB | 1531690 | A | 11/1978 |

OTHER PUBLICATIONS

Search Report and Written Opinion for PCT/US2006/009218.

* cited by examiner

*Primary Examiner* — Carlos A Rivera
(74) *Attorney, Agent, or Firm* — Carlson, Gaskey & Olds, P.C.

(57) ABSTRACT

A combustion chamber louver assembly includes an aft louver having a forward panel 24 that extends axially from a louver leading edge 26 to a corner 28, and a forward louver joined to the forward panel of the aft louver. A lip 48 defined by a portion of the forward louver that extends axially past the corner to a louver trailing edge 36 includes circumferentially distributed trailing edge slots 60 extending forwardly from the trailing edge a nominal distance equal to about 88% to 95% of the length L of the lip.

18 Claims, 4 Drawing Sheets

CRACK RESISTANT COMBUSTOR

TECHNICAL FIELD

This invention relates to combustion chamber liners for turbine engines and specifically to a crack resistant combustion chamber louver assembly.

BACKGROUND

Turbine engine combustion chamber liners may be made of multiple, axially successive louvers circumscribing a combustion chamber centerline. A typical louver has a forward panel, an aft panel and a short bulkhead that projects radially to connect the forward and aft panels to each other. A louver assembly comprises a forward louver and an aft louver arranged so that the aft panel of the forward louver nests radially inside the forward panel of the aft louver. The aft panel of the forward louver also extends axially past the connecting bulkhead of the aft louver to define a lip. A weld joint extends circumferentially to join the forward panel of the aft louver to the aft panel of the forward louver. The lips of certain louvers, particularly louvers that are not near the axially forward end of the liner, may include a series of circumferentially distributed slots. These lip slots help relieve thermal stresses that could cause cracks in the lips of those louvers. Experience shows that such lip slots are unnecessary in the louvers residing closer to the forward end of the liner.

Turbine engine manufacturers strive to minimize undesirable exhaust emissions arising from combustion of a fuel and air mixture in the combustion chamber. U.S. Pat. Nos. 6,101,814 and 6,715,292 (the contents of both of which are incorporated herein by reference) describe a combustor liner and associated fuel injector that produce considerably reduced emissions in comparison to early generation combustion liners. Throughout this specification the low emissions liner described in the aforementioned patents will be referred to as an intermediate generation liner; the predecessor to the intermediate generation liner will be referred to as an early generation liner. Experience reveals that a louver near the forward end of the early generation liner, specifically the second louver L2, does not require lip slots in order to resist cracking of the lip. Similarly, no lip slots are required in the second louver L2 of the intermediate generation liner to resist cracking of the lip. However in the intermediate generation liner, the forward panel of the axially adjacent aft louver (louver L3) exhibits susceptibility to cracking in the immediate vicinity of the weld joint that secures the louvers to each other. The cracking is believed to arise because a portion of forward louver L2 that is relatively hot during engine operation nests radially inside of a portion of aft louver L3 that is relatively cool during engine operation. The relatively cool portion of aft louver L3 is unable to withstand the cyclic, thermally induced radial expansion (and contraction) of the relatively hot portion of forward louver L2. The cracking is undesirable because it requires more frequent inspections than would otherwise be necessary and may also require replacement or reconditioning of an otherwise serviceable liner or its louvers.

What is needed is a combustor liner louver assembly whose louvers exhibit improved forward panel crack resistance.

SUMMARY

One embodiment of the louver assembly described herein includes an aft louver having a forward panel that extends axially from a louver leading edge to a corner, and a forward louver joined to the forward panel of the aft louver. A lip defined by a portion of the forward louver that extends axially past the corner to a louver trailing edge includes circumferentially distributed trailing edge slots extending forwardly from the trailing edge a nominal distance equal to about 88% to 95% of the length of the lip.

The foregoing and other features of the various embodiments of the louver assembly will become more apparent from the following description of the preferred embodiment and the accompanying drawings.

DETAILED DESCRIPTION

This invention is predicated in part on the recognition that crack susceptibility in the forward panel of a louver is related to differences in thermal expansion of that louver relative to an adjacent louver. Moreover, the remedy for mitigating the crack susceptibility involves modifying the adjacent louver at a location offset from the crack initiation site of the crack susceptible louver.

Figure 1:
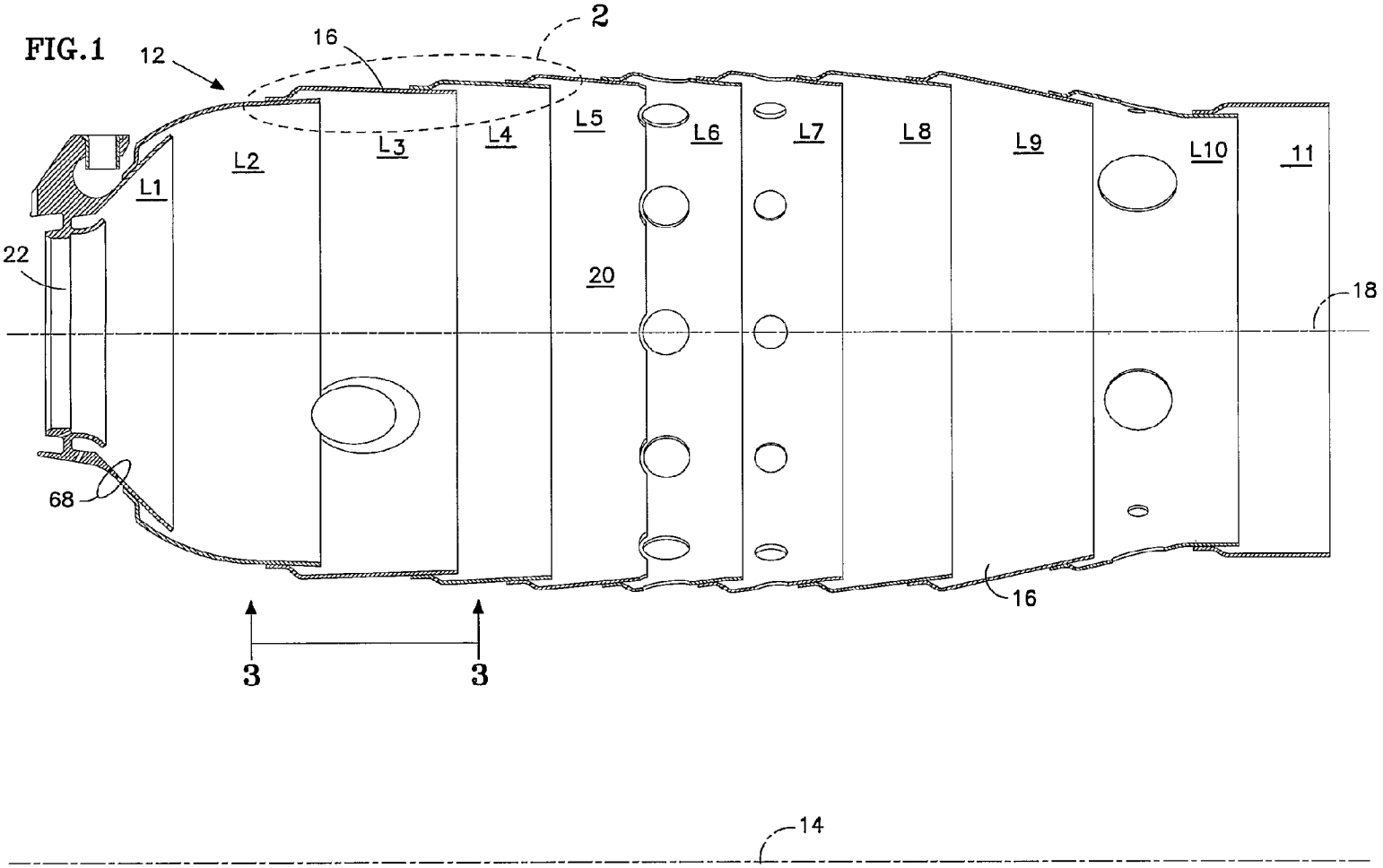
FIG. 1 is a side elevation view of a combustor can comprising multiple, axially successive louvers L1 through L11.
Figure 2:
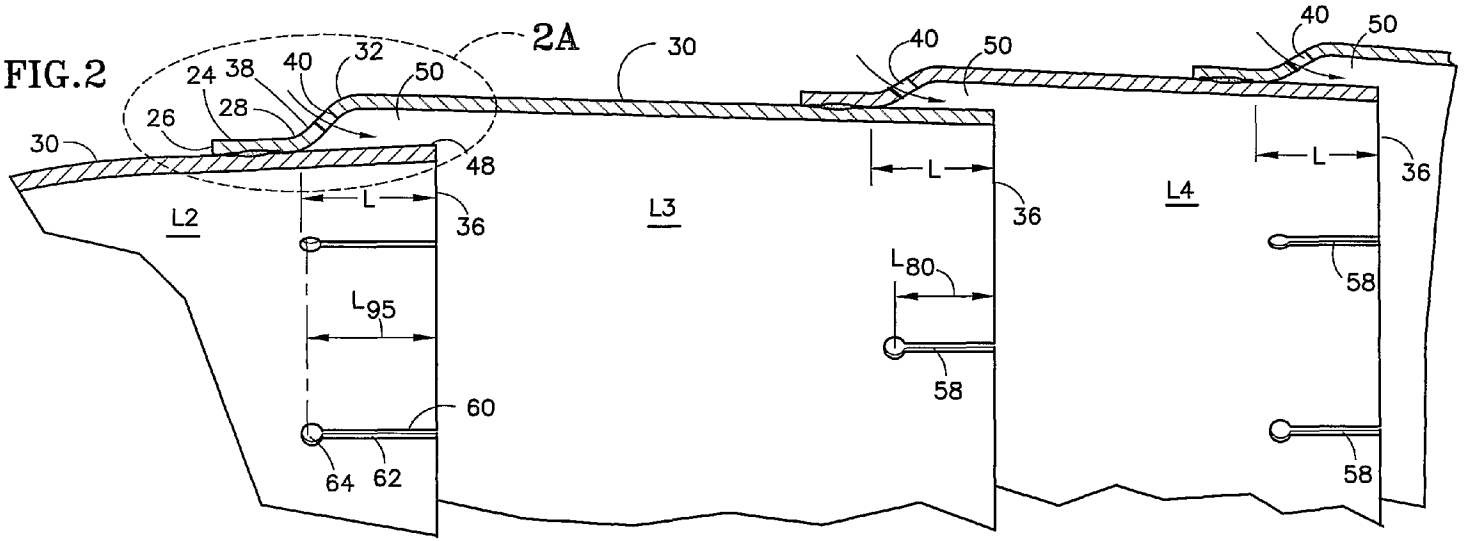
FIG. 2 is a perspective view of a portion of the combustor can of FIG. 1.
Figure 2A:
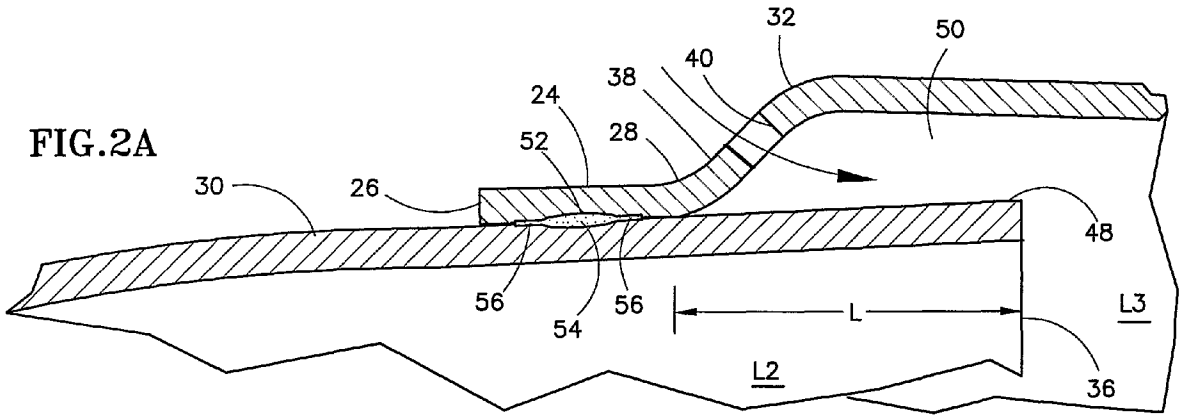
FIG. 2A is an enlarged, view of portion 2A of FIG. 2.

FIGS. 1, 2 and 2A show a combustion chamber liner 12' for a gas turbine engine. The illustrated liner is a combustor can and is one of nine such cans circumferentially distributed about an engine axis 14 to form a can-annular combustor. Each liner 12 includes eleven axially successive louvers 16 (individually labeled L1 through L11) each in the form of an integral ring. Each liner circumscribes a combustion chamber centerline 18 to define a combustion chamber 20. A fuel injector, not shown, projects through opening 22 at the forward end of the can. A typical louver 16 has a forward panel 24 extending axially from a louver leading edge 26 to a rounded, radially inner corner 28, and an aft panel 30 extending from a rounded, radially outer corner 32 to a louver trailing edge 36. A bulkhead 38 projects radially outwardly from the forward louver to connect the forward and aft panels to each other. Circumferentially distributed coolant admission holes 40 penetrate the bulkhead. The holes in louver L2 are all of equal size. The holes 40 in louvers L3 through L11 are grouped in clusters of holes. Each cluster occupies a sector of the bulkhead circumference. All the holes in a given cluster are of the same size (i.e. flow area) however the holes in a given cluster are not necessarily the same size as the holes in other clusters. The described clustering arrangement accommodates the three dimensional distribution of gas temperature in the combustion chamber.

Figure 3:
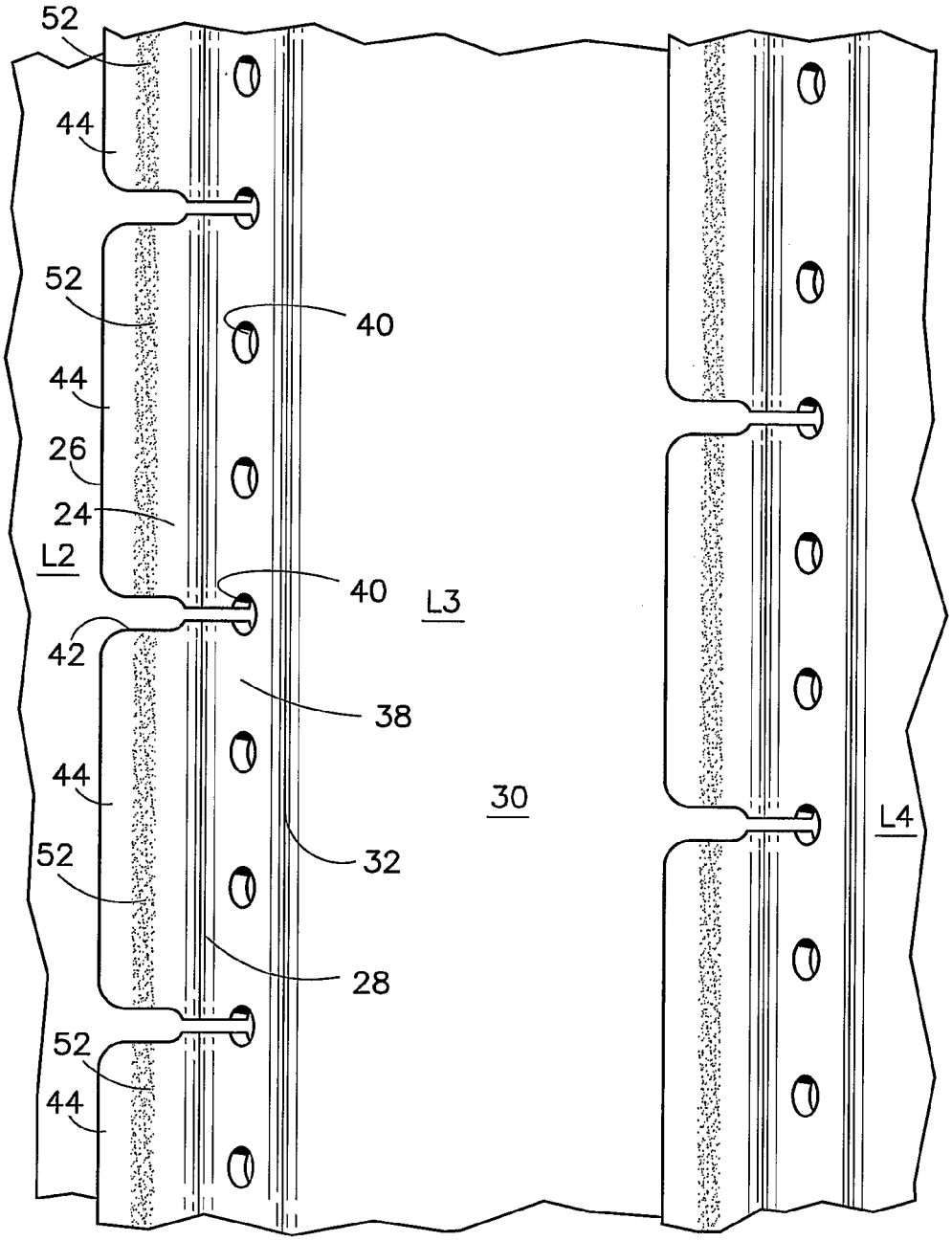
FIG. 3 is a developed view taken in the direction 3-3 of FIG. 1.

Referring additionally to FIG. 3, twenty four circumferentially distributed flexure slots, such as slot 42, define a series of tabs 44 in the forward panel of louvers L3 through L11. Each slot extends from the louver leading edge 26 to an associated coolant hole 40, however only one of every three coolant holes is associated with a flexure slot. The flexure slots impart flexibility to the forward panels to facilitate mating of axially adjacent louvers.

As seen best in FIGS. 2 and 2A, a louver assembly comprises a forward, radially inner louver such as L2, and an aft, radially outer louver such as L3 arranged so that part of the aft panel 30 of the forward louver nests radially inside the forward panel 24 of the aft louver. The aft panel of the forward louver also extends axially past the bulkhead 38 of the aft louver to define a lip 48. Specifically, the aft panel of the forward louver extends axially past the radially inner corner 28 of the aft louver to define the lip 48 and an associated annulus 50. The lip has a length L measured from the trailing edge to the radially inner corner 28. The annulus receives a coolant fluid by way of the coolant holes 40. The coolant forms a coolant film on the louvers to help protect them from the intense heat of combustion occurring inside the combustion chamber 20.

A weld joint 52 joins the forward louver to the forward panel of the aft louver. As seen best in FIG. 3, the weld joint is circumferentially quasi-continuous since it is locally interrupted by the flexure slots 42. The weld joint includes a weld nugget 54 axially bordered by regions of weld runout 56 (FIG. 2A).

Referring to FIG. 2, louvers L3 through L10 include twenty four circumferentially distributed lip slots 58. Each lip slot has a keyhole configuration comprising a linear portion and a circular or otherwise rounded terminus. Each lip slot 58 is circumferentially aligned with one of the twenty four flexure slots 42 in the same louver. However the lip slots of a given louver are circumferentially offset from the flexure slots of the axially neighboring louver by 7.5 degrees. Each lip slot, as measured from the louver trailing edge to the center of the circular terminus, has a length $L_{80}$ of about 80% of the length L of the louver lip. Since the lips on louvers L3 through L10 are all about 0.350 inches (0.89 centimeters) long, each of the slots is about 0.280 inches (0.71 centimeters) long. These slots 58 help relieve thermal stresses that could cause cracks in the lips of the louvers L3 through L10.

In early generation liners, the dilution hole pattern differs from that of the intermediate generation liners, and the lip of louver L2 is devoid of slots analogous to slots 58. Experience has shown that the lip of louver L2 in these early generation liners is not susceptible to cracking related to thermal stress. The intermediate generation liners employ the dilution hole pattern described in the patents incorporated herein by reference, but, like the early generation liners, also do not employ slots analogous to slots 58 in louver L2. These intermediate generation liners also are not known to be susceptible to cracking in the lip of louver L2. However the intermediate generation liners exhibit a susceptibility to cracking in the relatively cool forward panel 24 of aft louver L3. The crack initiation site is aft of the weld runout 56 immediately aft of the weld nugget 54. This cracking of the forward panel of aft louver L3 is believed to arise from thermally induced radial expansion of the relatively hot portion of louver L2 (which is the forward louver from the perspective of louver L3) in the vicinity of the forward panel 24 of louver L3. The cracking of the forward panel is believed to occur in the intermediate generation liner, but not in the early generation liner, because of a modified gas temperature distribution arising from interactions attributable to the dilution hole pattern and the innovative fuel injector described in the patents incorporated by reference.

Louver L2 includes circumferentially distributed trailing edge slots 60 axially offset from the forward panel of louver L3. The slots are keyhole slots comprising a linear portion 62 and a circular or otherwise rounded terminus 64. Each trailing edge slot 60 is circumferentially aligned with one of the twenty four flexure slots 42 in louver L2. However the trailing edge slots of louver L2 are circumferentially offset from the flexure slots of louver L3 by 7.5 degrees. The slots 60 extend forwardly from the trailing edge 36 of louver L2 a nominal distance $L_{95}$ equal to about 88% to 95% of the length L of the lip and preferably about 95% of the length L of the lip. The nominal distance is the distance from the trailing edge 36 to the center of the circular terminus 64. The length L of the lip on louver L2 is about 0.425 inches (1.08 centimeters). Accordingly, the preferred length of the slot is about 0.405 inches (1.03 centimeters).

Figure 4:
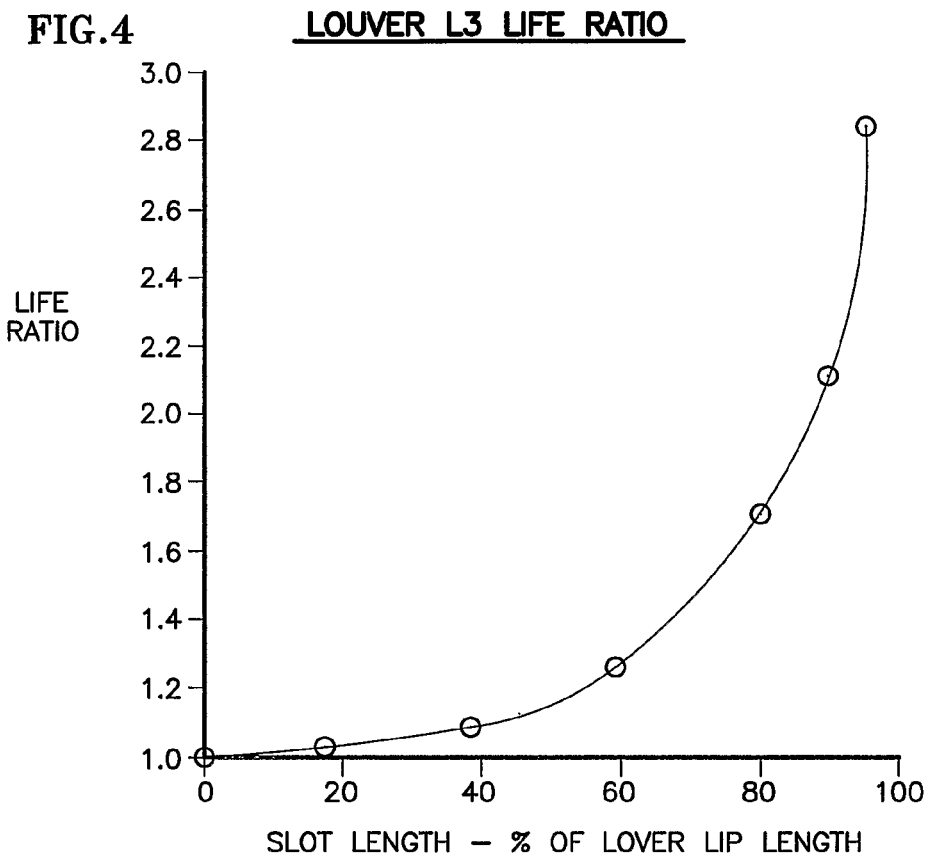
FIG. 4 is a graph showing the improved service life of a louver assembly as disclosed herein.

FIG. 4 shows a graph of the predicted life of louver L3 expressed as the life of a slotted louver divided by the life of an unslotted louver (i.e. a louver with a trailing edge slot length of zero) where louver life is measured in engine cycles. The life expectancy is shown as a function of slot length expressed as a percentage of lip length. The prediction is based on a coarse grid finite element model of a sector of the disclosed liner. As is evident from the graph, the slot in louver L3 yields an impressive gain in louver life.

Intermediate generation combustion liners can be upgraded by cutting through louver L1 at the approximate location 68 (FIG. 1) thereby allowing the aft end of louver L1 and louvers L2 through L11 to be separated as a unit from the forward end of L1. The separated louver assembly can then be scrapped or recycled. An upgraded louver assembly comprising the aft end of a louver L1 and louvers L2 through L11 and also including the trailing edge slots 60 in L2 is then attached, for example by welding, to the residual forward end of the original louver L1. As already described, the trailing edge slots 60 measure about 88% to 95% and preferably 95% of the length L of the louver lip. This upgrade method is not only time efficient but is also cost effective because the forward end of L1 is the most costly part of the liner.

Combustor liners can also be upgraded, albeit less cost effectively and less time efficiently, by installing the trailing edge slots 60 in an unslotted louver (e.g. louver L2) of those liners. The upgrade involves removing the unslotted louver from the liner, and securing a slotted louver having trailing edge slots measuring about 88% to 95% and preferably 95% of the length L of the louver lip to the liner in place of the unslotted louver. The slotted louver may be the same louver as the previously unslotted louver upgraded to include the slots 60, or may be a newly manufactured replacement louver or may be a used, previously unslotted louver taken from a pool of louvers that have been upgraded by installing the slots 60 therein.

Figure 5:
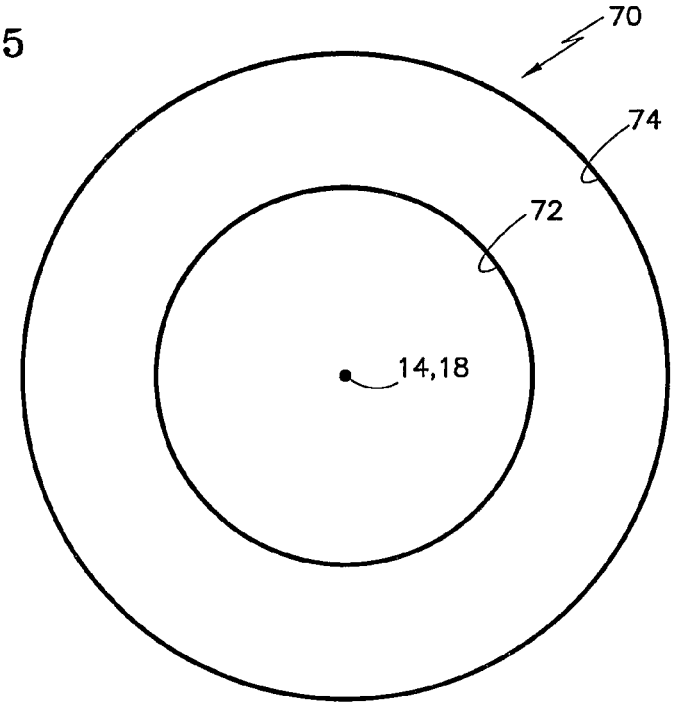
FIG. 5 is a schematic illustration of an annular combustor

The foregoing discussion describes the liner and associated method of upgrade in the context of a combustor can for a can-annular combustor. However as seen in FIG. 5, the concept can be applied to the louvers of an annular combustor 70 having radially inner and outer liners 72, 74 constructed of louvers substantially as already described.

Although this disclosure refers to specific embodiments, it will be understood by those skilled in the art that various changes in form and detail may be made without departing from the subject matter set forth in the accompanying claims.

We claim:

1. A combustion chamber louver assembly, comprising:

an aft louver having a forward panel that extends axially aft from a louver leading edge to a corner of the forward panel of the aft louver; and a forward louver joined to the forward panel of the aft louver and having a lip defined by a portion of the forward louver that extends axially aft past the corner of the forward panel of the aft louver to a louver trailing edge, the lip having a length L and including circumferentially distributed trailing edge slots extending forwardly from the trailing edge a nominal distance equal to about 88% to 95% of the length of the lip.

2. The louver assembly of claim 1 wherein the nominal distance is equal to about 95% of the length L of the lip.

3. The louver assembly of claim 1 wherein the aft louver is a radially outer louver and the forward louver is a radially inner louver.

4. The louver assembly of claim 1 wherein the slots are keyhole slots.

5. The louver assembly of claim 1 including a bulkhead projecting from the corner and wherein fluid admission holes penetrate the bulkhead.

6. The louver assembly of claim 5 wherein the fluid admission holes are not all equal in size.

7. The louver assembly of claim 1 in which circumferentially distributed flexure slots define a series of tabs in the forward panel.

8. The louver assembly of claim 7 in which the flexure slots are circumferentially aligned with the trailing edge slots.

9. The louver assembly of claim 1 including a bulkhead projecting from the corner and fluid admission holes penetrating the bulkhead and wherein circumferentially distributed flexure slots define a series of tabs in the forward panel, the flexure slots extending from the leading edge to an associated fluid admission hole.

10. The louver assembly of claim 1 wherein the forward louver is joined to the forward panel of the aft louver by a weld joint.

11. A turbine engine combustor can including the louver assembly of claim 1.

12. An annular turbine engine combustor liner including the louver assembly of claim 1.

13. The combustion chamber louver assembly of claim 1 wherein the forward louver is a radially inner louver including circumferentially distributed flexure slots defining a series of tabs, the aft louver is a radially outer louver and wherein the trailing edge slots reduce reducing radial thermal growth related crack susceptibility in the forward panel of the aft louver.

14. A method of upgrading a combustion chamber liner having multiple, axially adjacent louvers, comprising the steps of:

cutting through a selected louver to separate an aft end of the selected louver and louvers aft of the selected louver from a residual forward end of the selected louver, the selected louver being a louver forward of a louver that requires an upgrade; and securing an upgraded louver assembly to the residual forward end of the selected louver, wherein one of the separated louvers aft of the selected louver has a lip devoid of trailing edge slots and wherein the upgraded louver assembly includes an upgraded counterpart of the one louver, the upgraded counterpart including a lip with a lip length L and also including trailing edge slots measuring about 88% to 95% of the lip length L.

15. The method of claim 14 wherein the trailing edge slots measure about 95% of the lip length L.

16. The method of claim 14 wherein the liner has eleven louvers and the selected louver is the forwardmost of the eleven louvers.

17. A method of upgrading a combustion chamber liner having multiple, axially adjacent louvers, comprising the steps of:

removing an unslotted louver from the liner; and securing a slotted louver having trailing edge slots measuring about 88% to 95% of a length L of a louver lip to the combustion chamber liner in place of the unslotted louver.

18. The method of claim 17 wherein the trailing edge slots measure about 95% of the length L of the louver lip.

* * * * *